US005891216A

United States Patent [19]

Washburn et al.

[11] Patent Number: 5,891,216

[45] Date of Patent: Apr. 6, 1999

[54] OVEN MERCURY RETORTING DEVICE

[75] Inventors: Charles H. Washburn, Salt Lake City; Charles O. Gale, Bountiful, both of Utah

[73] Assignee: Summit Valley Equipment and Engineering, Inc., North Salt Lake, Utah

[21] Appl. No.: 931,426

[22] Filed: Sep. 16, 1997

[51] Int. Cl.[6] ..... C22B 43/00

[52] U.S. Cl. ..... 75/670; 266/149; 266/153

[58] Field of Search ..... 266/149, 153, 266/148; 75/670

[56] References Cited

U.S. PATENT DOCUMENTS 2,273,929 2/1942 Brotherton ..... 266/153

4,606,762 8/1986 Sikander et al. ..... 75/670

4,913,407 4/1990 King ..... 266/148

*Primary Examiner*—Scott Kastler

*Attorney, Agent, or Firm*—Mallinckrodt & Mallinckrodt

[57] ABSTRACT

A retorting device for mercury containing material, with an oven, mercury trap and condensers capable of operation at pressures from atmospheric pressure down to 50 Torr with simultaneous temperatures up to 1500° F. A dam within the mercury trap permits removal of liquid mercury separate from condensed solid amalgams, sludges and the like. The trap has provisions for removal of the sludges and amalgams from beneath the surface of water within the trap.

25 Claims, 10 Drawing Sheets

OVEN MERCURY RETORTING DEVICE

BACKGROUND OF THE INVENTION

1. Field

The field of the invention is retorting devices for removing mercury from ores and other mercury bearing materials.

2. Prior Art

The mercury-bearing material may be gold electrowinning sludge, Merrill-Crowe precipitate, smelter gas cleaning sludge, or any other material requiring removal of mercury. The material is commonly placed into an oven adapted for high temperature operation. The oven may be insulated in the interior on walls, top and door with mineral wool board or ceramic fiber cloth. The bottom may be insulated by fire brick or castable refractory material. Trays of the material are heated to volatilize the mercury, the resulting vapor then being directed through condensers, generally water cooled, to liquify the mercury vapor. The oven is subjected to vacuum to promote the volatilization of the mercury during the heating of the mercury bearing material.

Prior art retorting ovens are capable of operating temperatures of only 900°–1100° F., a temperature which does not thoroughly remove the mercury. Prior art mercury retorting ovens are unable to be operated under absolute pressures lower than 500–600 Torr, further limiting mercury removal. This is largely because the oven doors warp excessively at very high temperatures, breaking the oven vacuum seal. The oven and door frames are of common state of the art flange type components, which warp substantially at very high temperatures. Another shortcoming of prior art mercury retorting systems is that the mercury traps can only collect an unseparated mixture of the free mercury and other materials generally present in the condensate.

Therefore a need exists for an oven type retorting device which is capable of operating at much higher temperatures than presently available, in combination with lower operating pressures than are presently available, and that also incorporates an easily cleanable trap with provisions for separating the free mercury from any amalgams or sludge which may be condensed from oven gaseous effluent along with the mercury.

SUMMARY OF THE INVENTION

With the foregoing in mind, the inventive mercury retorting device comprises an oven which can be operated at temperatures up to 1500° F., and at simultaneous absolute pressures as low as 50 Torr, said operating temperatures and pressures being achieved through unique oven and oven door constructions. The door employs a continuous, integral peripheral frame comprising hollow tubular members which provide high resistance to heat produced warping. The oven opening is similarly framed, and is also highly resistant to high temperature geometric torsional deflections. If required, cooling air may be directed through the interior of the hollow framing to further reduce distortion at high oven temperatures.

Preferably, a small, continuous flow of ambient air is utilized to purge or sweep the heavy mercury vapor from the bottom of the oven during operation.

Besides the oven, the retorting device further comprises a number of condensers, preferably water cooled, which convert the gaseous mercury effluent from the oven to liquid form, and discharges it into a tank trap to be collected beneath water along with other condensates. The liquid mercury is subsequently allowed to flow from the bottom of the downwardly sloping trap into a mercury collection pot. A vacuum pump maintains the entire system, other than the final mercury collection pot, under the aforementioned low vacuum including the condensers, the trap and the oven.

The trap includes an internal baffle downwardly suspended from the top of the trap to below the water surface, to direct the gaseous effluent from the oven upwardly through the first of three condensing stages. A flow conduit then directs the effluent to pass downwardly through a second condensing stage to the space above the water but past the suspended barrier, which recovers further mercury from the oven effluent gas. Finally, the gases then flow from the trap upwardly to be subjected to the remaining condensing stage.

The trap also includes a below-water weir extending upwardly from the bottom of the trap near the lowered outlet end. This barrier prevents the outflow of any heavier metals, amalgams and sludges present in the condensate. These materials are heavier than mercury, so that it may be collected in relatively pure form in comparison to prior art traps, which do not separate these materials.

The trap has clean-out ports through which sludges and the like may be scooped from the bottom of the trap beneath the water using manual tools. This feature increases the safety of the trap by reducing any possible operator exposure to mercury vapor if present.

It is therefore the principal object of the invention to provide an oven-type mercury retorting system with improved efficiency in which the oven may operate at greatly increased temperatures and greatly decreased pressures, the system also having a trap for condensed mercury which produces mercury of increased purity.

BRIEF DESCRIPTION OF THE DRAWINGS

In the drawings, which represent the best modes for carrying out the invention.

DETAILED DESCRIPTION OF ILLUSTRATED EMBODIMENT

Figure 1:
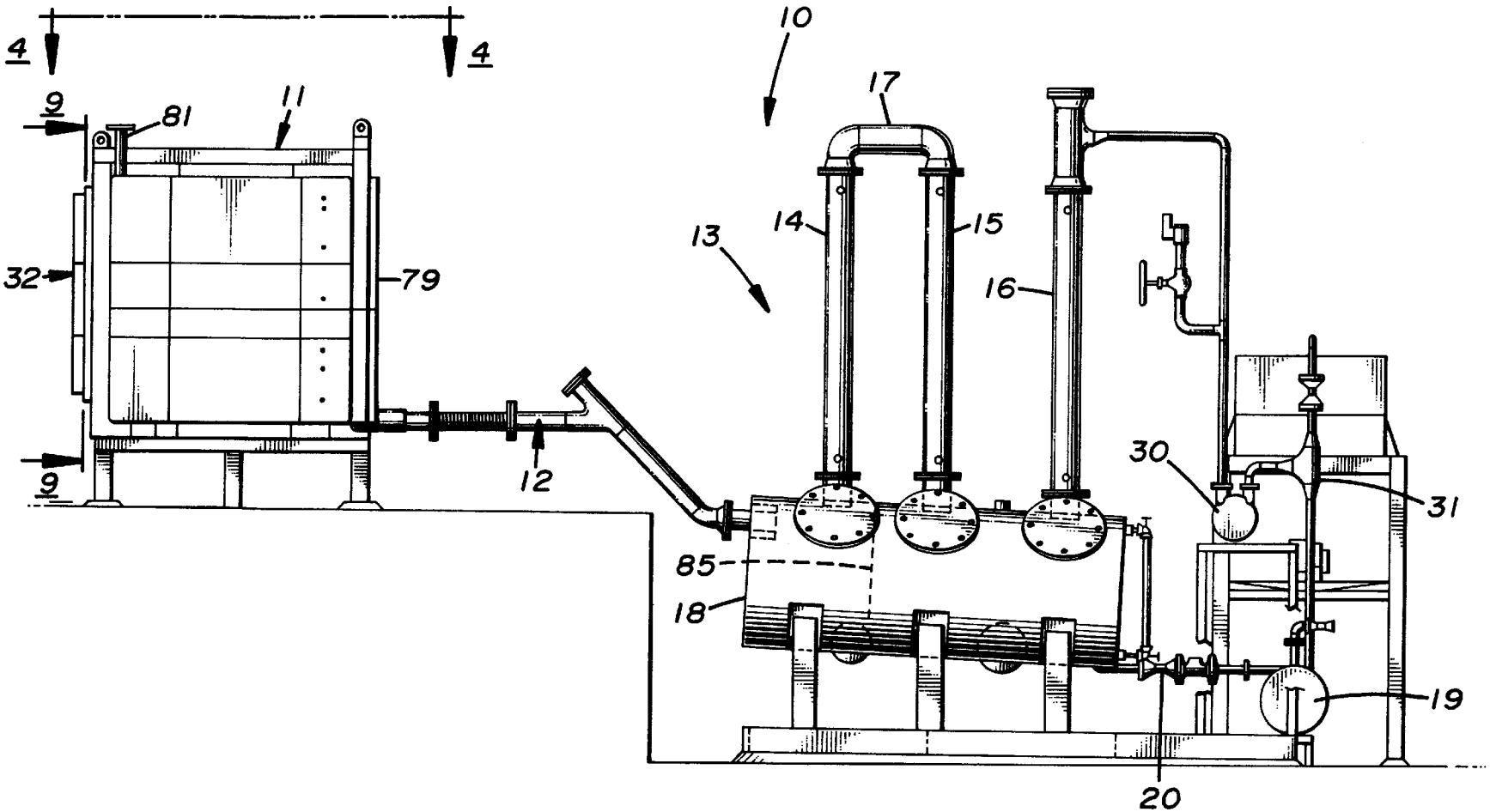
FIG. 1 is a reduced scale side elevation view of the oven mercury retorting device.

An oven mercury retorting device 10 in accordance with the invention is shown in FIG. 1. The material to be retorted is first placed in an oven 11 where it is subjected to temperatures as high as 1500° at simultaneous pressures as low as 50 Torr.

Figure 8:
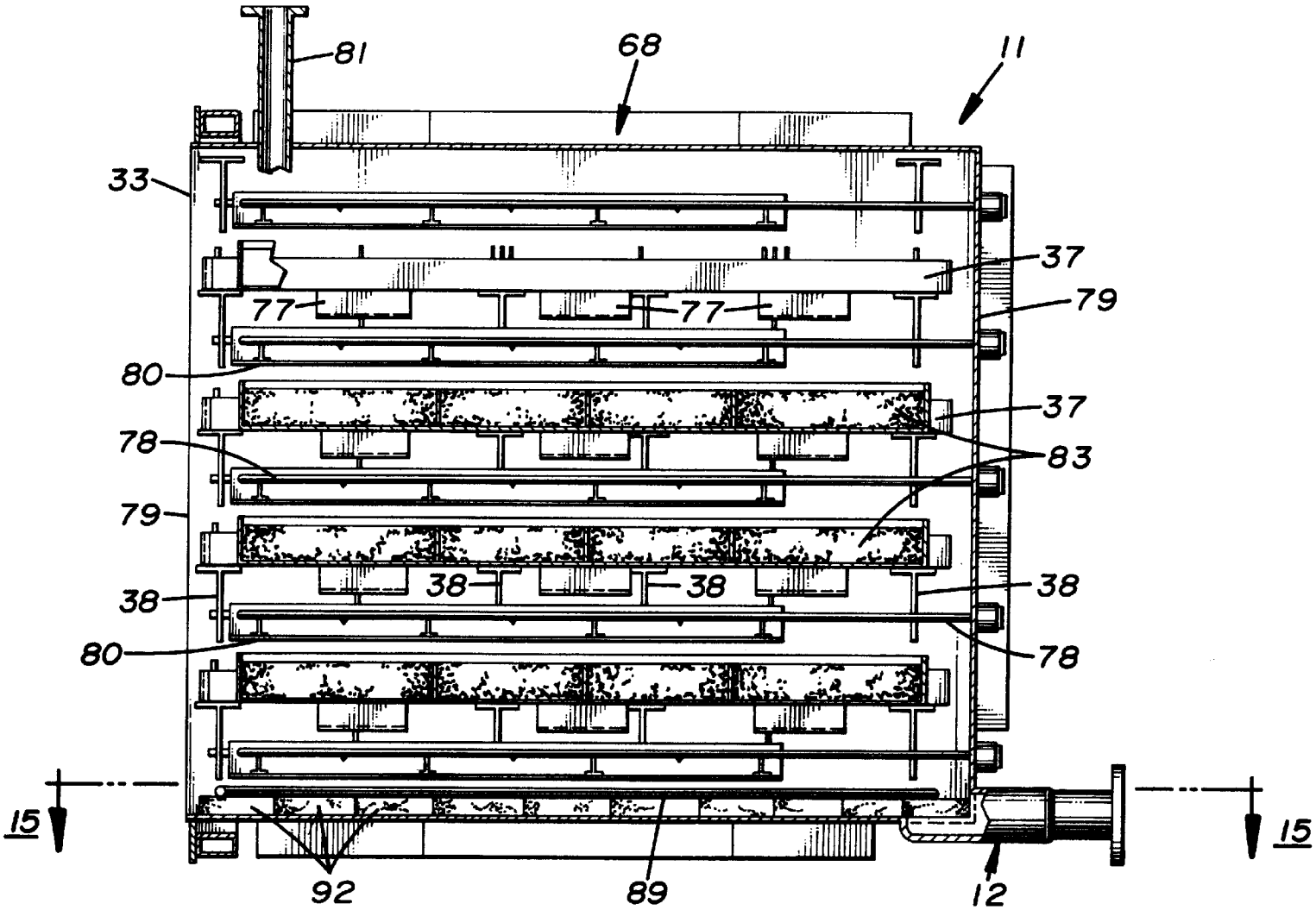
FIG. 8 a longitudinal vertical sectional view taken on the line 8—8 of FIG. 4, showing the oven of the oven mercury retorting device with the oven door removed, showing the retort material pans heating elements, and air inlet and gaseous effluent outlet pipes, drawn a larger scale than FIG. 4.
Figure 9:
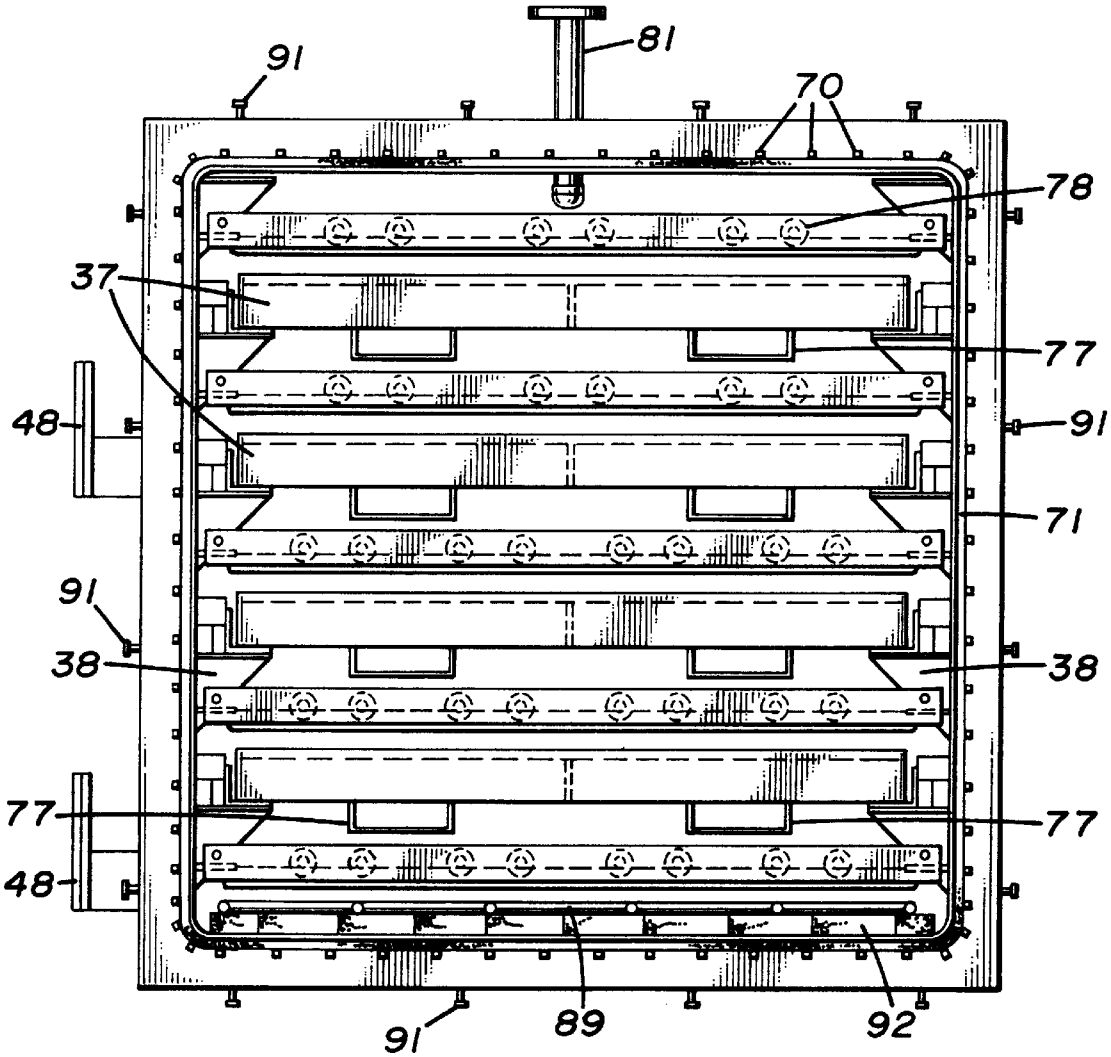
FIG. 9 a front elevational view of the oven of the oven mercury retorting device taken on the line 9—9 of FIG. 1, showing the retort material pans, brackets, heating elements, bricks, and the sealing plate about the open end of the oven shell, drawn to the scale of FIG. 8.
Figure 11:
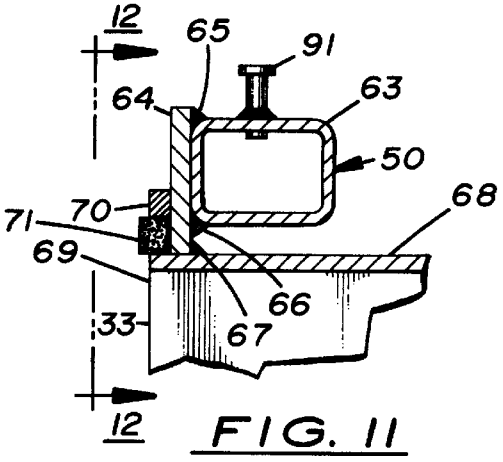
FIG. 11 a fragmentary longitudinal vertical sectional view taken on the line 11—11 of FIG. 10, showing the tubular frame member about the open end of the oven, the seal plate, the seal member, and the seal retaining projections, drawn to a larger scale than that of FIG. 10.
Figure 12:
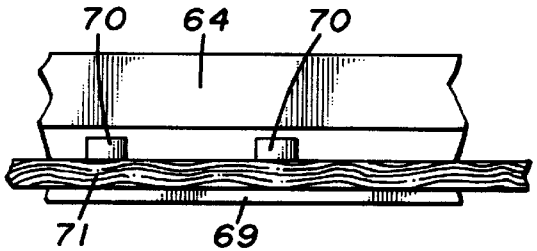
FIG. 12 a fragmentary front elevational view taken on the line 12—12 of FIG. 11 showing the seal plate, the seal member, and the seal holders, drawn to the same scale as FIG. 11.
Figure 10:
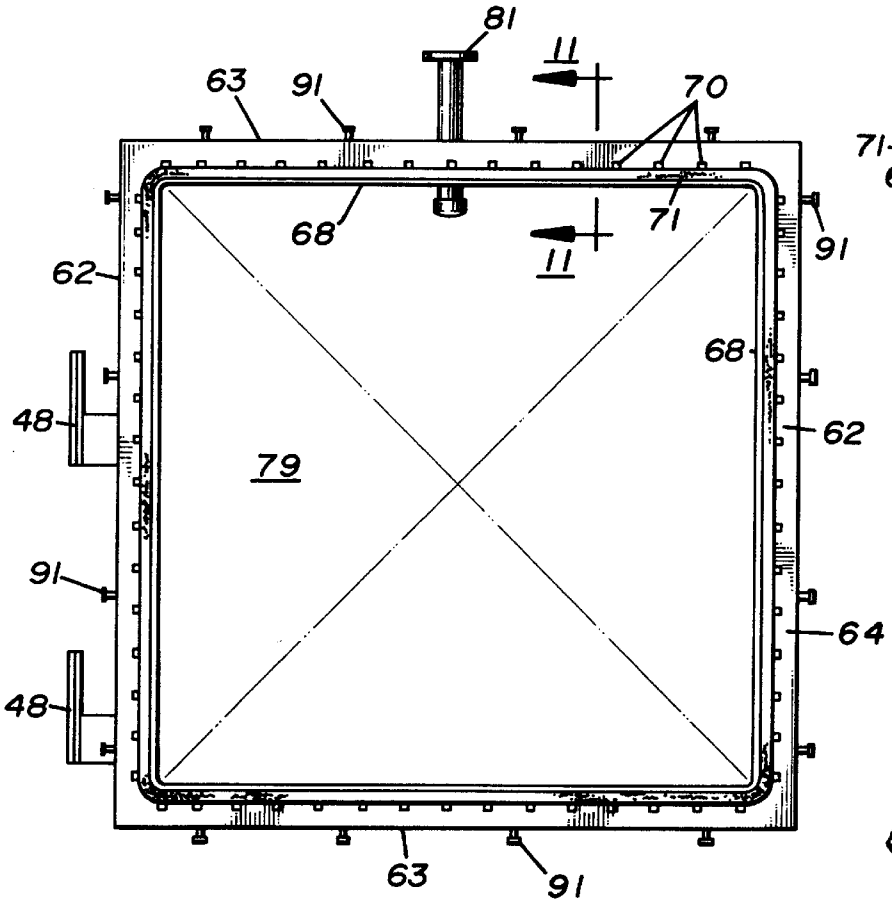
FIG. 10 a front elevational view corresponding to FIG. 9 of the front end opening of the oven without the retort material pans, brackets, heating elements, and bricks, drawn to about the same scale as FIG. 9.
Figure 15:
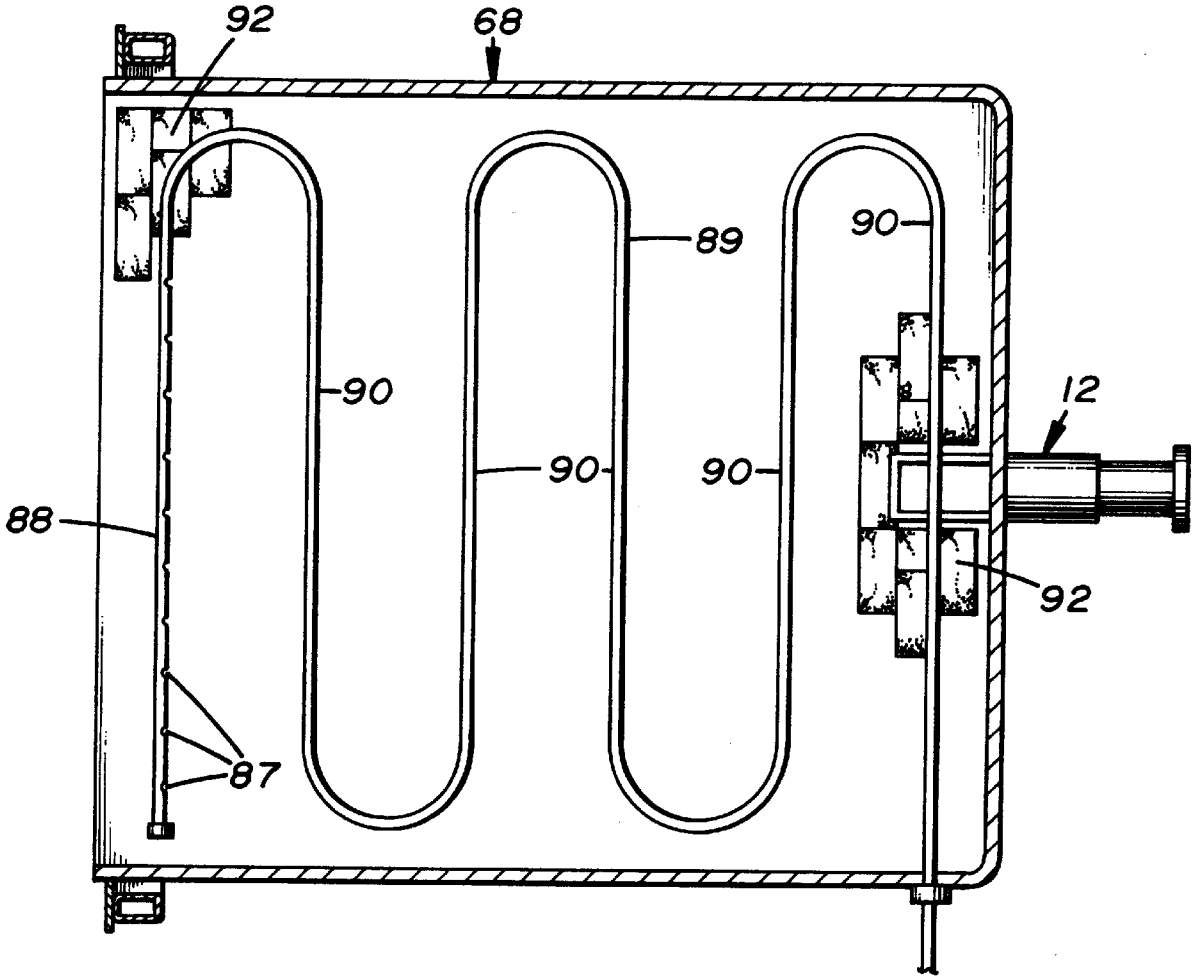
FIG. 15 a longitudinal horizontal sectional view taken on the line 15—15 of FIG. 8, drawn to the same scale as FIG. 8, showing the sweep air inlet tube.

Pans 37 for retorting material 83 are placed into oven 11, supported by brackets 38 extending from the oven wall 68. (FIGS. 8 and 9) Forklift guides 77 enable each pan to be placed within and removed from oven 11. Horizontally positioned heating elements 78 extending between the pans 37 are supported from rear wall 79 of oven shell 68 and by brackets 80 within oven 11. Cooling down air inlet piping 81 pierces the top of body shell 68. During operation, gaseous effluent outflows through passage structure 12 to condenser and mercury trap 13, urged by a small continuous flow of ambient air allowed into the oven through orifices 87 in the end leg 88 of a serpentine tube 89, preheated by flow through preceding legs 90. (FIGS. 8, 9 and 15)

An important feature of the oven assembly 11 is this sweep air tube 89, located on the bottom of oven body shell 68, laying upon insulating fire brick 92. (Oven body 68 and door 32 also carry conventional internal insulation (not shown.) Air entering tube 89 is warmed by conduction before emerging from spaced apart holes 87, directed horizontally parallel to the fire brick 92 toward the gaseous outlet piping 12 leading to mercury trap 18 and condensers 14, 15 and 16. (FIG. 1) The flow of air, although small to avoid significant effect upon the internal pressure of the oven, prevents the heavy mercury vapor from pooling in the bottom of oven 11. From the oven the volatilized mercury travels through piping 12 to the condenser and mercury trap 13, impelled by air allowed to enter oven 11 through serpentine tube 89. (FIGS. 8, 9 and 15)

A tank trap 18 is partially filled with water and is connected to water cooled condensers 14, 15 and 16. A downwardly reaching barrier 85, indicated in dashed lines in FIGS. 1 and 2, directs the gaseous effluent from the oven 11 upwardly through condenser 14, and thence by passage member 17 to condenser 15 back into trap 18. The effluent then passes above the surface of the water in the trap 18 upwardly through condenser 16.

Condensed mercury falls by gravity from each of the condensers back into the trap 18 to be covered by the water. The trap 18, as well as the oven 11 and condensers 14, 15, and 16, are maintained at pressures as low as 50 Torr, which greatly aids in the volatization of the mercury from the retorting material 83.

Figure 2:
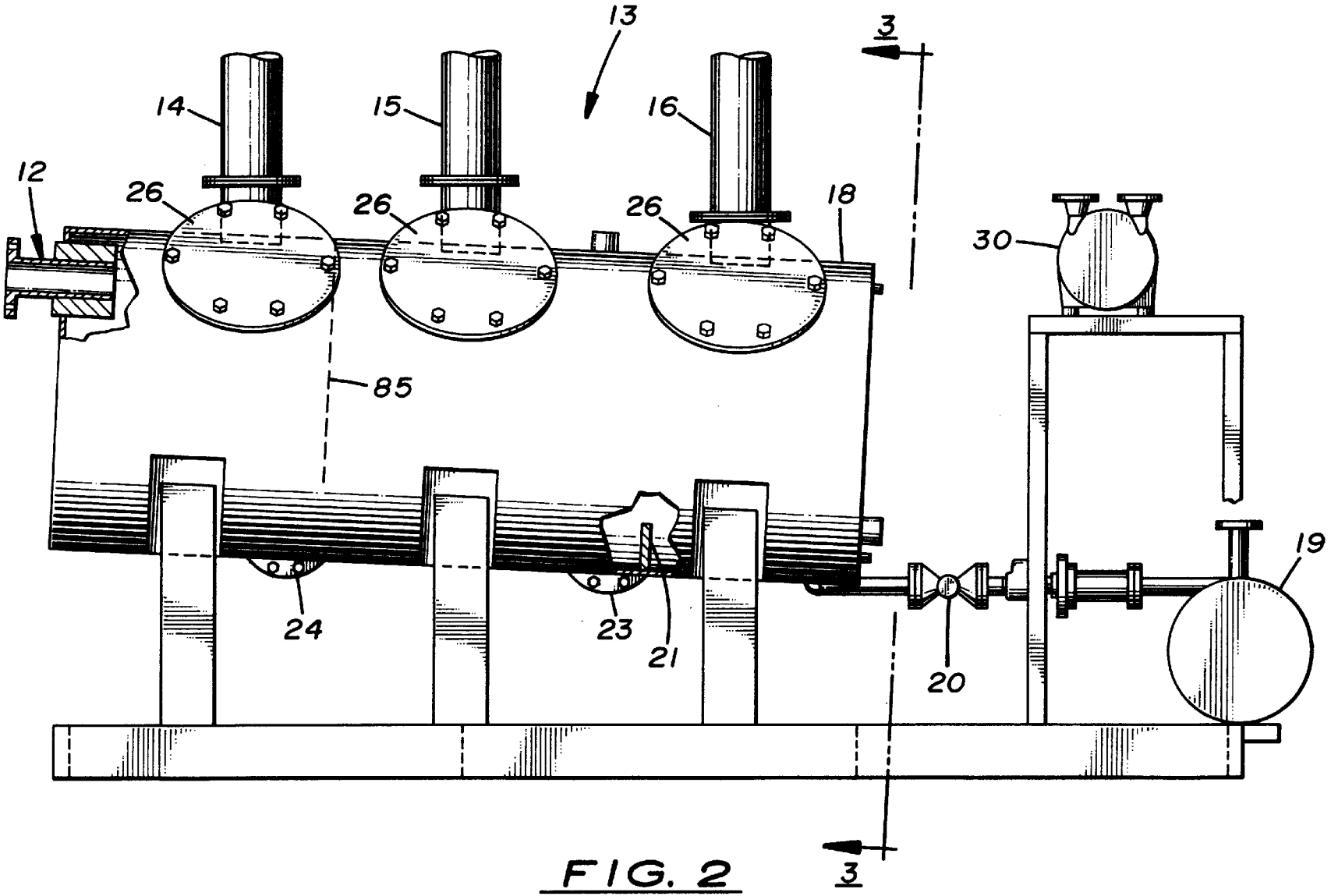
FIG. 2 a partially broken side elevation view of the mercury trap of the oven mercury retorting device, drawn to a larger scale than FIG. 1.
Figure 4:
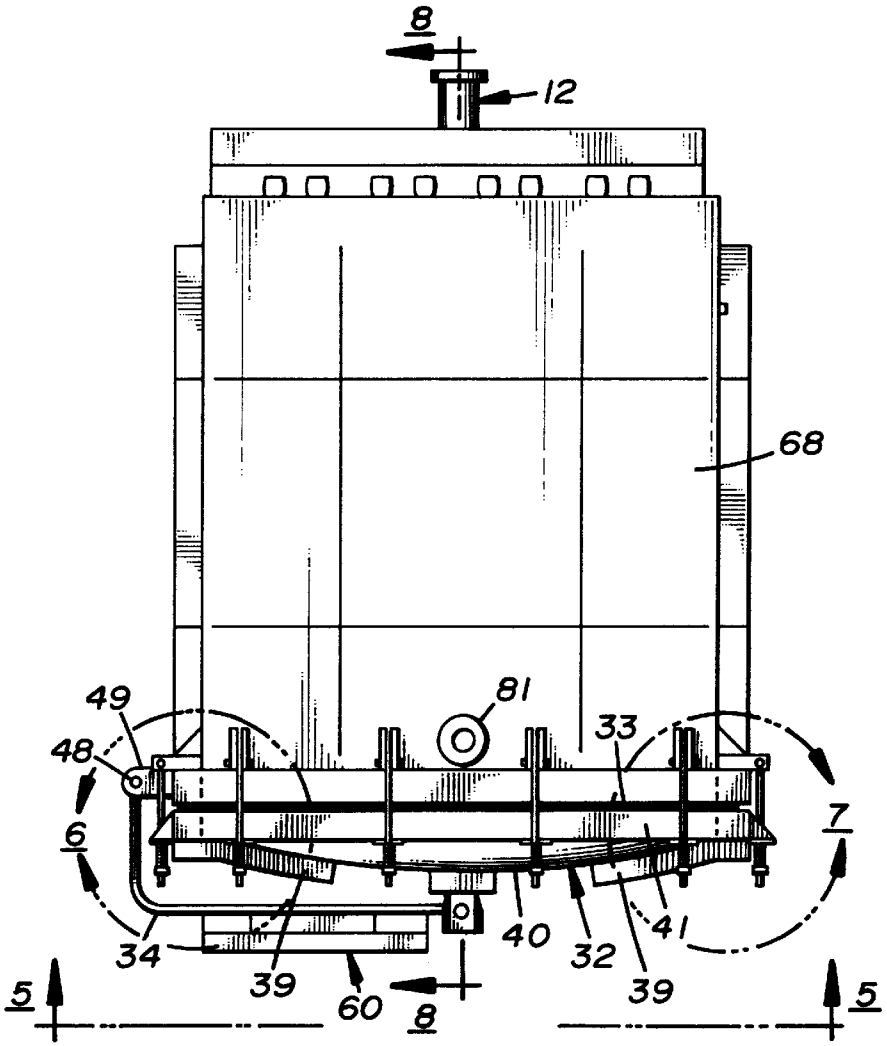
FIG. 4 a plan view of the oven of the oven mercury retorting device taken on the line 4—4 of FIG. 1 and rotated ninety degrees counter clockwise, drawn to a larger scale than FIG. 1.
Figure 3:
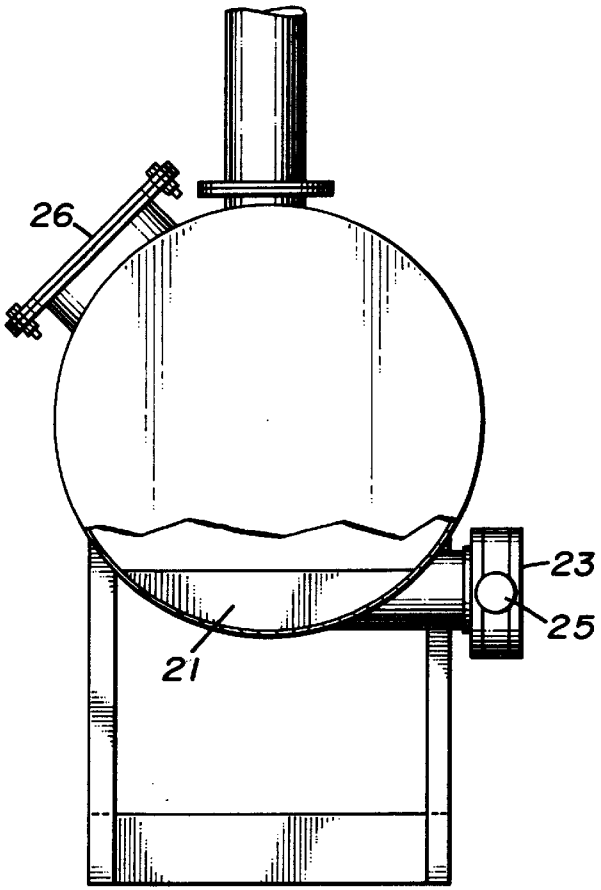
FIG. 3 a partially broken end elevation view of the trap of the oven mercury retorting device, taken along line 3—3 of FIG. 2, drawn to the same scale as FIG. 2.

The gaseous mercury condensed and deposited into trap 13 is periodically removed through valve 20 into a mercury pot 19. To separate the mercury from other materials such as zinc or cadmium which may have been vaporized and carried over into tank 18, a weir plate 21 is provided. (FIG. 2) Weir 21 allows the liquified mercury to flow to the outlet removal piping and valve 20, while the solid amalgams of mercury with other metals, sludge and the like are retained upstream of the weir 21 within the trap 18. A pair of bottom clean-out ports 23 and 24 permit sludge and the like which may accumulate after extended use to be removed from beneath the surface of the water, to minimize the exposure of the operator to any remaining liquid mercury. (FIGS. 2 and 3)

A drain valve 25 aids in the cleaning, often obviating the necessity of removing of a cap plate 26. (FIGS. 2 and 3) However, the bottom clean-out ports 23 and 24 are used infrequently. A manual dipping tool (not shown) is used through the upper ports (not shown) under cap plates 26 for routine clean out. The bottom sludge accumulates principally in the vicinity of weir 21.

After the vapor, principally air, remaining in the trap 18 and the rest of the system including the oven 11, and the connecting passage 17, is drawn off through a vacuum pump 30, it is directed through a mercury vapor scrubber 31. (FIG. 1)

Figure 5:
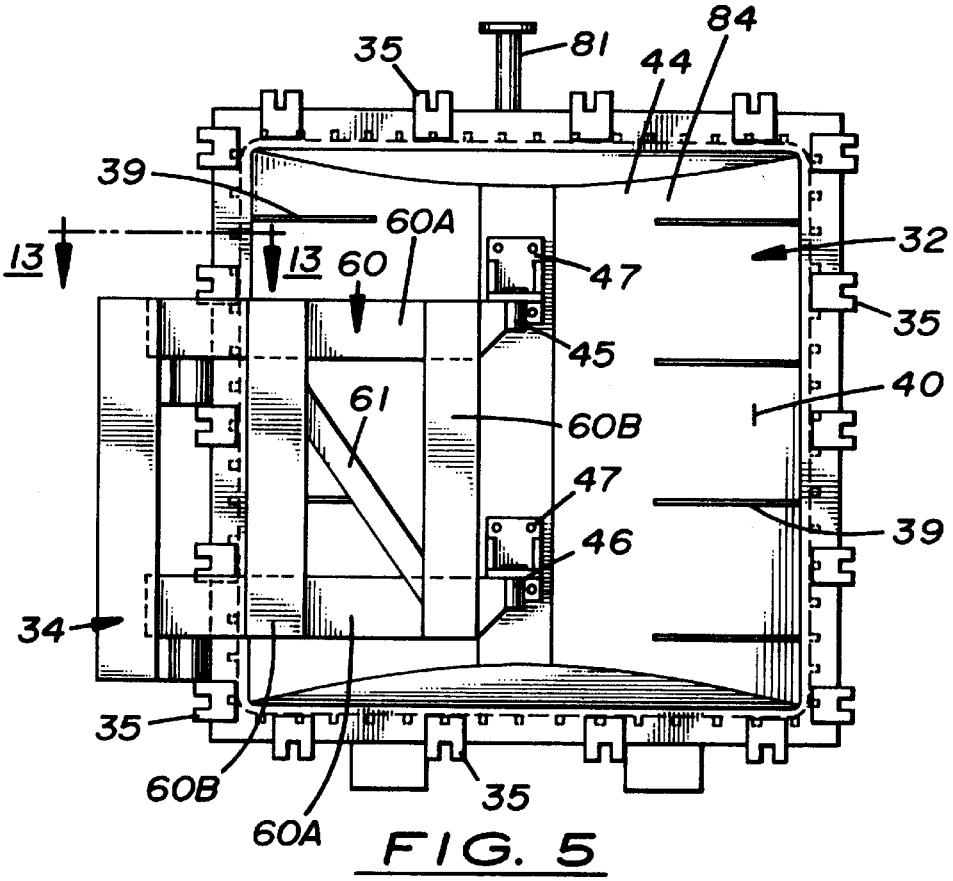
FIG. 5 a front elevation view of the oven taken on the line 5—5 of FIG. 4, drawn to the same scale as FIG. 4.
Figure 6:
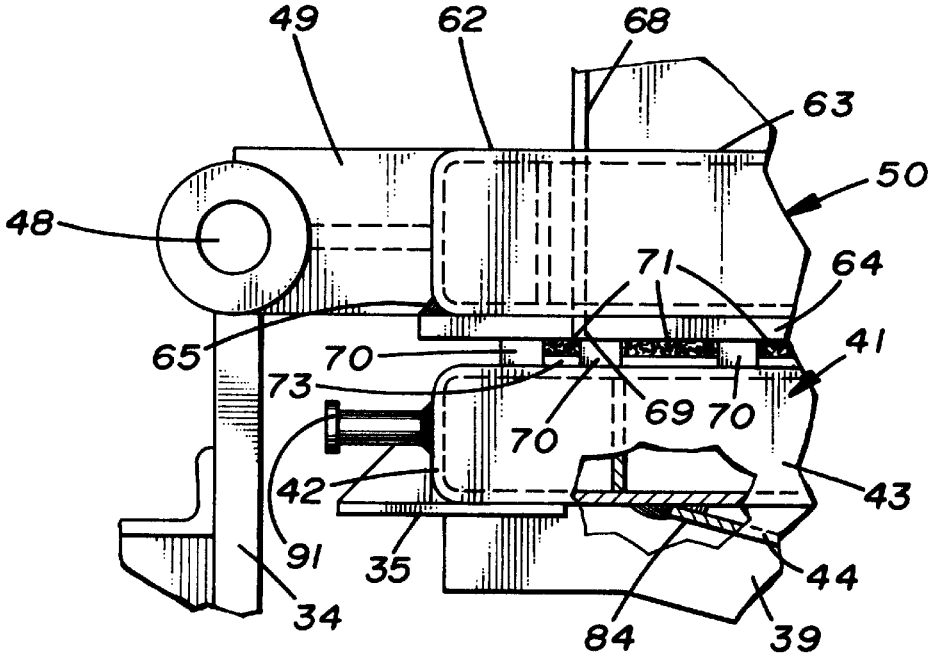
FIG. 6 a fragmentary view of the oven of the oven mercury retorting device taken on line 6—6 of FIG. 4, drawn to a larger scale than of FIG. 4, having a cutaway portion showing the welds securing the oven dome to the tubular door frame.
Figure 7:
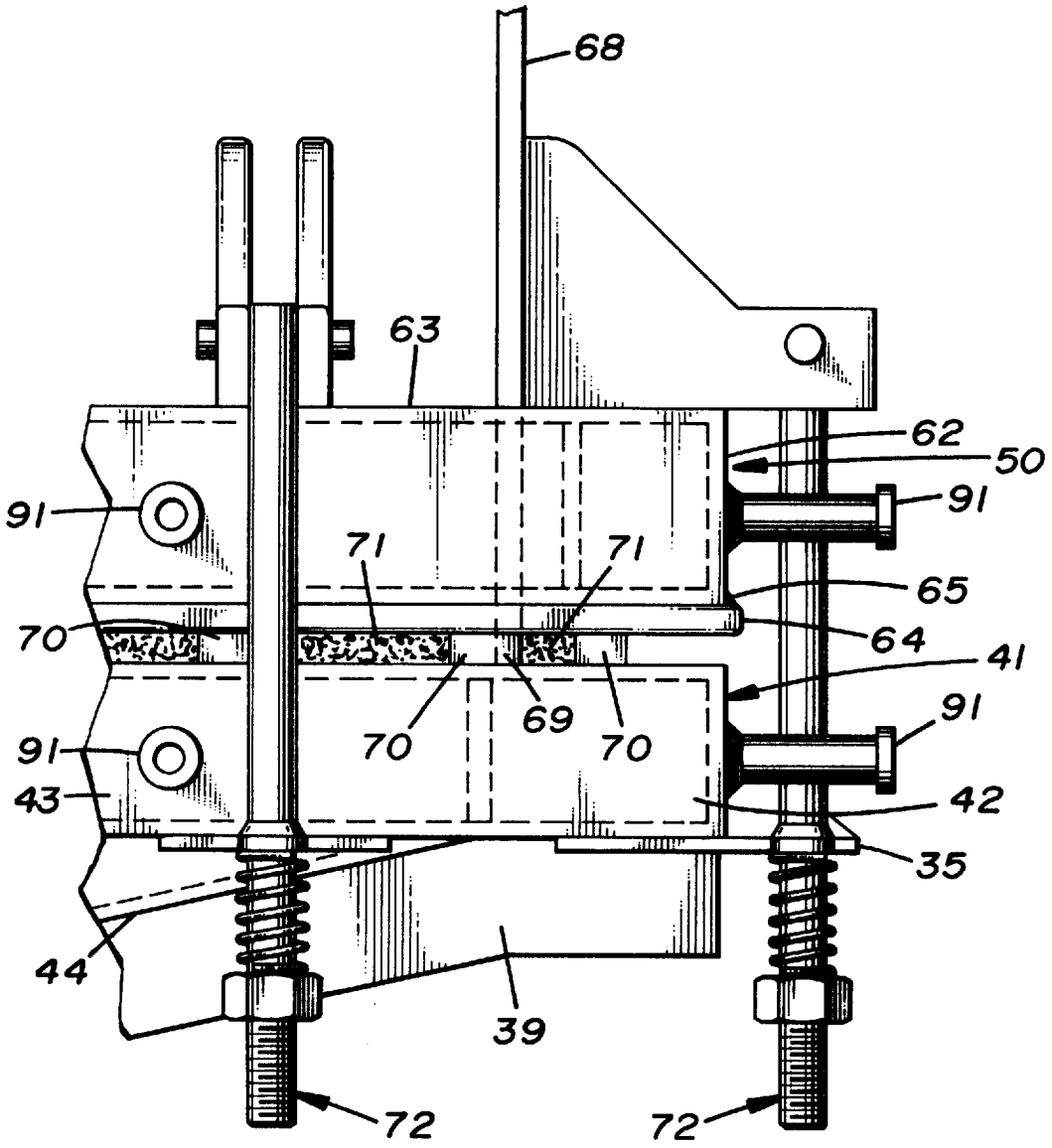
FIG. 7 a fragmentary view of the oven of the oven mercury retorting device taken on the line 7—7 of FIG. 4, drawn to a larger scale than FIG. 4, showing the door retaining toggles.
Figure 13:
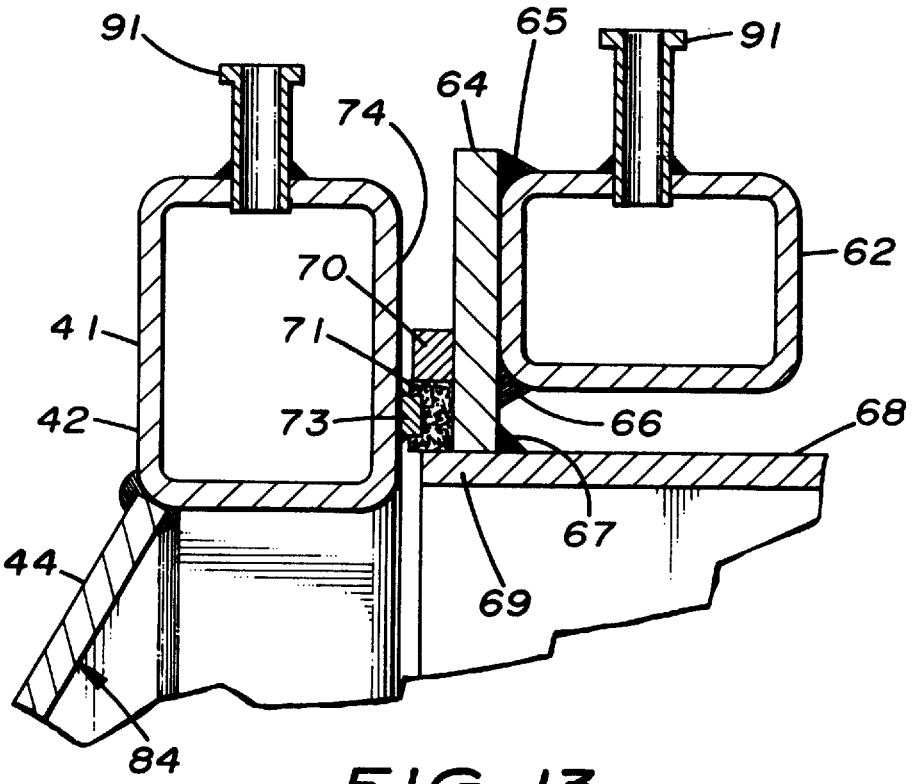
FIG. 13 a fragmentary sectional view taken on the line 13—13 of FIG. 5 and rotated ninety degrees clockwise, showing the tubular oven frame, the seal plate, the seal member and the seal compressor of the tubular door frame, drawn to a larger scale than FIG. 12.
Figure 14:
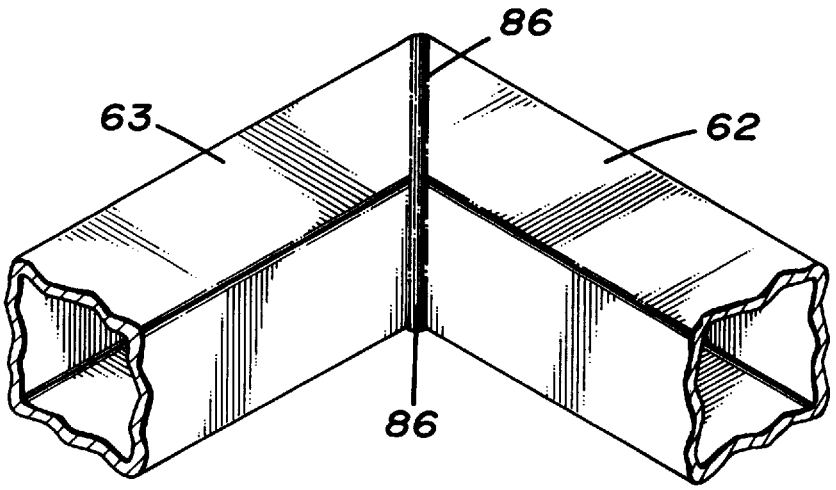
FIG. 14 a fragmentary perspective view of a typical corner of the oven frame and of the door frame showing the mitred, continuously welded ends of the tubular frame members, drawn to a smaller scale than that of FIG. 13.

Unique structural framing features of the oven door 32, which closes one of the ends of oven 11 and the oven end opening 33 enable the oven to operate at pressures down to 50 Torr with simultaneous temperatures up to 1500° F. (FIGS. 4–8) A hinge assembly 34 permits the opening and closing of door 32. Chairs 35 permit connection of spring loaded toggles 72. (FIG. 5 and 7) The main body shell 84 of the oven door 32 is dished outwardly providing a dome structure 44 to resist the inwardly directed unbalanced air pressure during use, while clearing oven trays 37 and tray brackets 38 interior to the oven 11. (FIGS. 5, 8 and 9) The outwardly dished structure is further stiffened by ribs 39 welded to dome structure external surface 40. The dome structure 44 contributes substantially to torsional rigidity of the door at high temperatures, but a lightweight door frame 41 provides needed extraordinary rigidity at very high temperatures. (FIGS. 4, 6, 7 and 13) Door frame 41 comprises hollow steel tubular members 42 and 43, to which dome shell 84 is continuously welded all around its periphery. (FIG. 6 and 13) The frame members 42 and 43 are end-mitred and joined together continuously by a weld 86 at all corner junctures, in the same manner as are oven framing members 62 and 63. (FIG. 14) This provides a rigid, completely integral structure, which is dimensionally stable at high temperatures. Both an oven frame 50 around oven opening 33, with hollow members 62 and 63, and door frame 41, with hollow members 42 and 43, may carry spaced apart nipples 91 allowing circulation of cooling air, if needed to prevent distortion at high oven operating temperatures. (FIGS. 6, 7 and 13)

The door is supported from the outwardly bulging dome structure 44 by hinge assembly 34, which is attached through pivots 45 and 46 onto respective brackets 47 at the center of door 32. The opposite end of hinge assembly 34 is secured to pivots 48. Hinge attaching brackets 49 are welded to oven door opening frame 50. (FIGS. 4 and 6) Hinge assembly 34 comprises plates 60A and 60B welded together to form a frame 60 which is diagonally stiffened by the brace plate 61.

The oven opening frame 50, comprising hollow tubular members 62 and 63 encircling the front of oven 11 with mitred ends continuously welded together at all corner junctions, is stiff and torsionally stable at high temperatures being further stiffened by a seal flange 64 secured thereto by continuous welds 65 and 66 all around end opening 33 oven. (FIGS. 11–14) The inside perimeter of seal flange 64 is continuously secured to oven body shell 63 all around by weld 67.

Seal flange 64 is offset rearwardly from an end 69 of oven body shell 68. A multiplicity of metallic retaining projections or seal holders 70 are spaced apart all around the seal flange 64, about oven body shell 68. Inwardly directed unbalanced pressure during oven operation tends to push a seal member 71 away from spaced apart seal holders 70, but against the protruding end 69 of oven body 68. This manner of use of the seal holders 70 eliminates expensive machining of a continuous, seal accepting groove all around the seal flange 64.

Seal member 71 comprises ¾"×¾" braided fiberglass strands. Such fiberglass "rope" is readily available on the open market. (FIGS. 12 and 13) To assure that seal member 71 is reliably engaged when door 32 is closed and secured by toggles 72 (FIG. 7), a steel compressor 73 is provided continuously welded all around the rearwardly facing surface 74 of door frame members 42 and 43. ¼"×¼" steel key stock may be utilized for compressor 73. (FIG. 13)

The inventive apparatus may be embodied in other specific forms without departing from the spirit or essential characteristics thereof. The present apparatus is therefore to be considered illustrative and not restrictive, the scope of the invention being indicated by the appended claims rather than by the foregoing description and all changes which come within the meaning and range of equivalency of the claims are therefore intended to be embraced therein.

What is claimed and desired to be secured by United States Letters Patent is:

1. A device for retorting mercury bearing materials, comprising:

an oven for heating the materials to volatilize the mercury, condensing means for liquefying the resultant gaseous mercury, trap means for collecting liquid mercury outflowing from the condensing means, receptacle means for collecting the liquefied mercury from the trap, vacuum means maintaining trap, condensing means, oven and connecting passages at sub-atmospheric pressures and means scrubbing the finally condensed gaseous affluent to remove remnants of mercury therefrom;

the oven having a rigid, warp-resistant frame surrounding an open front portion thereof, and a door for closing the open front portion having a rigid, warp-resistant frame and a seal member acting between the oven body and the door in an oven-closing position;

wherein the oven, condensing means, mercury trap, and connecting passages are capable of operation in the range of internal pressures from 50 Torr to atmospheric with simultaneous internal oven temperatures in the range of 500° to 1500° F.

2. A device for retorting mercury bearing materials, comprising:

an oven for heating the materials to volatilize the mercury, condensing means for liquefying the resultant gaseous mercury, trap means for collecting liquid mercury outflowing from the condensing means, receptacle means for collecting the liguefied mercury from the trap, vacuum means maintaining trap, condensing means, oven and connecting passages at sub-atmospheric pressures and means scrubbing the finally condensed gaseous affluent to remove remnants of mercury therefrom; wherein the oven comprises an oven body including:

a steel shell generally surrounding an internal space, having essentially closed bottom, top, side and rear portions and a substantially open front portion;

a rigid continuous frame continuously secured to the oven body shell all about the periphery of the open front portion thereof; and an oven door for closing the open front portion of the oven body, said door comprising;

a steel shell door body;

a rigid frame continuously welded to the door body shell all about the periphery thereof; and a seal member acting between the oven body and the door when the door is in oven-closing position; and wherein the oven, condensing means, mercury trap, and connecting passages are capable of operation in the range of internal pressures from 50 Torr to atmospheric with simultaneous internal oven temperatures in the range of 500° to 1500° F.

3. The retorting device of claim 2, wherein:

the oven front opening frame is continuously welded to a seal plate all around the front opening, the seal plate being continuously welded all around to the oven shell at the open front portion thereof, the seal plate carrying means for retaining the sealing member all around the front portion of the body of the oven; so that the oven is sealed against entry of air thereinto when the door is secured to the open front portion of the oven body in contact with the sealing member retained all around the oven front opening.

4. The retorting device of claim 3, wherein:

the seal plate is welded to the outside surface of the oven shell, positioned rearwardly of the frontmost edge of said shell;

the seal plate carries projection means spaced outwardly from and all around the frontmost edge of the oven body; so that the sealing member may be retained upon the seal plate between the projection means and the adjacent portion of the oven shell, the sealing member being of sufficient thickness for the rearmost portion of the door to bear sealingly thereagainst all around when the door is secured in oven closing position.

5. The retorting device of claim 4, wherein the door frame further comprises:

a continuous seal compressing member of lesser width than that of the sealing member, rearwardly projecting from the rearward face of the door frame all around, positioned and proportioned to everywhere bear against the sealing member when the door is secured to the open front portion of the oven body in oven closing position.

6. The retorting device of claim 3, wherein:

the frame about the open front portion of the oven comprises;

continuous tubular steel members with identical cross sections and mitred ends joined together by a continuous endless weld to form each corner juncture, said frame being continuously welded to the seal plate; and the door body frame comprises;

continuous tubular steel members with identical cross sections and mitred ends joined together by a continuous endless weld to form each corner juncture, said frame being continuously welded to the periphery of the shell body of the door.

7. The retorting device of claim 6, wherein:

the tubular members of the door body frame bear sealingly against the sealing member all around.

8. The retorting device of claim 6, wherein the door frame further comprises:

a continuous seal compressing member of lesser width than that of the sealing member, rearwardly projecting from the rearward face of the door frame all around, positioned and proportioned to everywhere bear against the sealing member when the door is secured to the open front portion of the oven body in oven closing position; wherein the seal compressing member is carried by the tubular steel door frame members.

9. The retorting device of claim 8, wherein the oven further comprises:

hinge means connecting the oven door pivotally to the oven body frame; and releasable, spring loaded tension members disposed about the periphery of the oven door, acting between the frame of the door and the frame of the open front portion of the oven body shell, for securing the door evenly against the sealing member.

10. A device for retorting mercury bearing materials, comprising:

an oven for heating the materials to volatilize the mercury, condensing means for liquefying the resultant gaseous mercury, trap means for collecting liquid mercury outflowing from the condensing means, receptacle means for collecting the liquefied mercury from the trap, vacuum means maintaining trap, condensing means, oven and connecting passages at sub-atmospheric pressures and means scrubbing the finally condensed gaseous affluent to remove remnants of mercury therefrom, wherein the mercury trap thereof comprises:

elongate tank means supported generally horizontally with a volatile oven effluent inlet end thereof elevated above an opposite, liquid mercury, outlet end;

water partially filling the tank means;

condenser means connected to the tank means above the water therein, so that condensate therefrom flows into the water;

means directing gaseous effluent from the oven through the condenser means; and means for removing liquid mercury from the tank means from beneath the surface of the water while retaining other condensed materials; and wherein the oven, condensing means, mercury trap, and connecting passages are capable of operation in the range of internal pressures from 50 Torr to atmospheric with simultaneous internal oven temperatures in the range of 500° to 1500° F.

11. The retorting device of claim 10, wherein the means for removing liquid mercury while retaining condensed materials other than mercury comprises:

dam means extending upwardly from the bottom of the tank means at the mercury outlet end thereof.

12. The retorting device of claim 11, wherein the condensing means comprises:

three condensers through which the gaseous effluent from the oven is serially directed.

13. The retorting device of claim 12, wherein:

the three condensers are vertically disposed, each having an inlet end and an opposite outlet end; and the means directing gaseous effluent from the oven comprises dam means extending downwardly from the top of the tank directing said effluent upwardly into a downwardly placed inlet end of one of the condensers, conduit means connecting the upwardly disposed outlet end of said condenser to an upwardly positioned inlet end of another of the condensers, the outlet end of which is placed to discharge effluent into the space above the water, to then enter the downwardly placed inlet of the remaining one of the three condensers, final uncondensed effluent being drawn from the upwardly disposed outlet end of said remaining condenser.

14. A device for retorting mercury bearing materials, comprising:

an oven for heating the materials to volatilize the mercury, condensing means for liquefying the resultant gaseous mercury, trap means for collecting liquid mercury outflowing from the condensing means, means for introducing a flow of ambient air into the oven to impel the mercury vapor into the trap and condensing means, receptacle means for collecting the liquefied mercury from the trap, vacuum means maintaining trap, condensing means, oven and connecting passages at sub-atmospheric pressures and means scrubbing the finally condensed gaseous affluent to remove remnants of mercury therefrom; wherein the oven, condensing means, mercury trap, and connecting passages are capable of operation in the range of internal pressures from 50 Torr to atmospheric with simultaneous internal oven temperatures in the range of 500° to 1500° F.

15. The retorting device of claim 14, wherein:

the air flow inducing means includes means raising the ambient air temperature to oven internal temperature before flow thereof into the interior of the oven.

16. The retorting device of claim 15, wherein the flow inducing means comprises:

a metallic tube communicating between the interior of the oven and the ambient air, said tube being of sufficient length to permit the ambient air to be heated by conduction through the walls of the tube to oven interior temperature before emergence of the air from the tube into the interior of the oven.

17. The retorting device of claim 16, wherein:

the heated air emerges into the oven through spaced apart holes in the tube, so as to be distributed across the width of the bottom of the oven at the door end thereof.

18. The retorting device of claim 5, further comprising:

a metallic tube communicating between the interior of the oven and the ambient air, said tube being of sufficient length to permit the ambient air to be heated by conduction through the walls of the tube to oven interior temperature before emergence of the air from the tube into the interior of the oven; wherein the heated air emerges into the oven through spaced apart holes in the tube, so as to be distributed across the width of the bottom of the oven at the door end thereof.

19. The retorting device of claim 8, further comprising:

a metallic tube communicating between the interior of the oven and the ambient air, said tube being of sufficient length to permit the ambient air to be heated by conduction through the walls of the tube to oven interior temperature before emergence of the air from the tube into the interior of the oven; wherein the heated air emerges into the oven through spaced apart holes in the tube, so as to be distributed across the width of the bottom of the oven at the door end thereof.

20. The retorting device of claim 17, wherein the mercury trap thereof comprises:

elongate tank means supported generally horizontally with a volatile oven effluent inlet end thereof elevated above an opposite, liquid mercury, outlet end;

water partially filling the tank means;

condenser means connected to the tank means above the water therein, so that condensate therefrom flows into the water;

means directing gaseous effluent from the oven through the condenser means; and means for removing liquid mercury from the tank means from beneath the surface of the water while retaining other condensed materials, said liquid mercury removing means comprising dam means extending upwardly from the bottom of the tank means at the mercury outlet end thereof.

21. A trap for recovery of liquid mercury from gaseous mercury contained in the effluent from a mercury retorting device, said trap comprising:

elongate tank means supported generally horizontally with a volatile oven effluent inlet end thereof elevated above an opposite, liquid mercury, outlet end;

water partially filling the tank means;

condenser means connected to the tank means above the water therein, so that condensate therefrom flows into the water;

means directing gaseous effluent from the oven through the condenser means; and means for removing liquid mercury from the tank means from beneath the surface of the water while retaining other condensed materials, said liquid mercury removing means comprising dam means extending upwardly from the bottom of the tank means at the mercury outlet end thereof.

22. The retorting device of claim 6, wherein:

the tubular steel members of the oven frame each carry longitudinally spaced apart nipples each communicating with the interior of the members, so that a flow of cooling air may be impelled through the hollow centers of said members; and the tubular steel members of the door frame each carry longitudinally spaced apart nipples each communicating with the interior of the members, so that a flow of cooling air may be impelled through the hollow centers of said members.

23. The retorting device of claim 17, wherein:

the tubular steel members of the oven frame each carry longitudinally spaced apart nipples each communicating with the interior of the members, so that a flow of cooling air may be impelled through the hollow centers of said members; and the tubular steel members of the door frame each carry longitudinally spaced apart nipples each communicating with the interior of the members, so that a flow of cooling air may be impelled through the hollow centers of said members.

24. A process for retorting mercury bearing materials, comprising the steps:

heating the materials in an oven to a temperature in the range of 1100° to 1500° F. to volatilize the mercury;

condensing the resultant gaseous mercury to a liquid in a condensing means;

collecting liquid mercury outflowing from the condensing means in a trap means;

collecting the liquefied mercury from the trap means in a receptacle means;

maintaining the trap means, condensing means, oven and connecting passages at sub-atmospheric pressures of between 500 Torr and 50 Torr; and scrubbing the finally condensed gaseous affluent to remove remnants of mercury therefrom using a scrubbing means.

25. The process of claim 24, wherein the step of collecting liquid mercury outflowing from the condensing means in a trap means utilizes a trap means comprising:

elongate tank means supported generally horizontally with a volatile oven effluent inlet end thereof elevated above an opposite, liquid mercury, outlet end;

water partially filling the tank means;

condenser means connected to the tank means above the water therein, so that condensate therefrom flows into the water;

means directing gaseous effluent from the oven through the condenser means; and means for removing liquid mercury from the tank means from beneath the surface of the water while retaining other condensed materials, said liquid mercury removing means comprising dam means extending upwardly from the bottom of the tank means at the mercury outlet end thereof.

* * * * *